US006289755B1

(12) United States Patent
Rush

(10) Patent No.: US 6,289,755 B1
(45) Date of Patent: Sep. 18, 2001

(54) DRIVE TRANSMISSION ASSEMBLY

(75) Inventor: John Bertram Derrek Rush, Tyne B Wear (GB)

(73) Assignee: Bonas Machine Company Limited, New Castle Upon Tyne (GB)

( * ) Notice: Subject to any disclaimer, the term of this patent is extended or adjusted under 35 U.S.C. 154(b) by 0 days.

(21) Appl. No.: 09/297,777

(22) PCT Filed: Dec. 1, 1997

(86) PCT No.: PCT/GB97/03309

§ 371 Date: Oct. 7, 1999

§ 102(e) Date: Oct. 7, 1999

(87) PCT Pub. No.: WO99/13144

PCT Pub. Date: Mar. 18, 1999

(30) Foreign Application Priority Data

Sep. 9, 1997 (GB) ..... 9718987

(51) Int. Cl.[7] ..... F16H 21/44; F16H 21/54; F16H 25/18; D03C 3/00

(52) U.S. Cl. ..... 74/110; 139/59; 139/85

(58) Field of Search ..... 74/110; 139/455, 139/59, 329, 88, 85, 86

(56) References Cited

U.S. PATENT DOCUMENTS 3,747,647 7/1973 Bergmann ..... 139/59
5,511,588 * 4/1996 Jakšić ..... 139/455
5,636,663 * 6/1997 Lacrdix ..... 139/86

FOREIGN PATENT DOCUMENTS 0051548 5/1982 (EP) .
0330624 8/1989 (EP) .
0374279 6/1990 (EP) .
2509333 1/1983 (FR) .
2510619 2/1983 (FR) .

* cited by examiner

*Primary Examiner*—David Fenstermacher
(74) *Attorney, Agent, or Firm*—Dann, Dorfman, Herrell and Skillman; Henry H. Skillman

(57) ABSTRACT

A drive transmission assembly for transmitting motive drive between a reciprocating drive member (11) and a driven member (16) in order to move the driven member (16) between first and second limits of reciprocal movement, the assembly including a drive transmission member (20) adapted for connection to the drive member (11) and the driven member (16) in order to transmit said motive drive, a fixed stop member (22) arranged to be located within the path of reciprocal travel of said transmission member (20), the transmission member (20) including a stop (25) for abutment with said stop member (22) in order to define said first or second limit of reciprocal movement for the driven member (16), said transmisson member (20) being adapted to define a vibration isolating connection between said stop (25) and said drive member (11), whilst said stop (25) is in abutment with said stop member (22).

8 Claims, 3 Drawing Sheets

DRIVE TRANSMISSION ASSEMBLY

The present invention relates to a drive transmission assembly for transmitting motive drive between a reciprocating drive member and a driven member.

In particular, the present invention relates to such a transmission assembly which is used to connect the output from a Jacquard mechanism to the heald(s).

It is a common condition in jacquards that the Jacquard output to the loom is subject to small oscillation either at bottom shed or top shed or both, in addition to the normal lifting and lowering of the outputs which takes place as ends are selected and deselected. Elimination of these oscillations within the Jacquard may be difficult or impossible without considerable changes to the mechanism or extensive fine adjustment of the machine. Components of vertical oscillation may also occur because of vibrations in the Jacquard mounting and the gantry. These secondary oscillations can however be very detrimental to the other components of the weaving system, such as the harness.

According to one aspect of the present invention there is provided a drive transmission assembly for transmitting motive drive between a reciprocating drive member and a driven member in order to move the driven member between first and second limits of reciprocal movement, the assembly including a drive transmission member adapted for connection to the drive member and the driven member in order to transmit said motive drive, a fixed stop member arranged to be located within the path of reciprocal travel of said transmission member, the transmission member including a stop for abutment with said stop member in order to define said first or second limit of reciprocal movement for the driven member, said transmission member being adapted to define a vibration isolating connection between said stop and said drive member whilst said stop is in abutment with said stop member.

Preferably dampening means are provided for dampening impact of the stop with said stop member.

Various aspects of the present invention are hereinafter described with reference to the accompanying drawings, in which.

Figure 1:
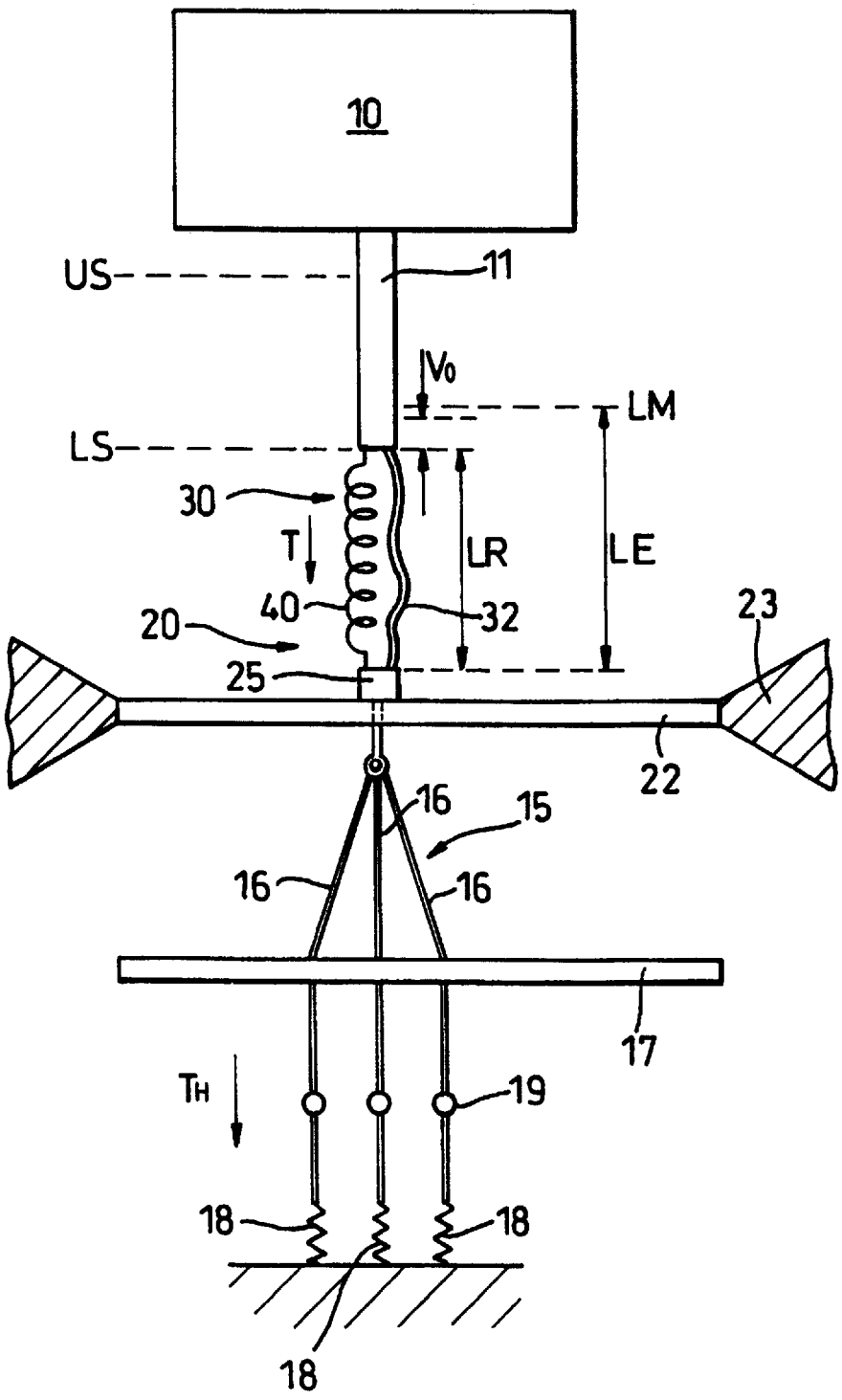
FIG. 1 is a diagrammatic view illustrating the principle of operation of a drive transmission assembly according to the present invention.

Referring initially to FIG. 1, there is shown a Jacquard mechanism 10 including an output member 11 which is moved, when selected, between upper shed US and lower shed LS positions. Jacquard mechanisms 10 of this type are well known, for example see GB 2047755.

The output member 11 is drivingly connected to a heald harness 15 via a transmission assembly 20 according to the present invention. The harness 15 in the illustration comprises three harness cords 16. Each harness cord 16 passes through a comber board 17 and is connected to a spring 18 in a conventional manner. The springs 18 collectively apply a downward biasing force $T_H$ on the transmission assembly 20. Each harness cord 16 carries a heald 19 in a conventional manner. The transmission assembly 20 includes a stop member 22 which is preferably rigid and fixedly supported so as to be isolated from vibrations in the Jacquard 10. Preferably the stop member 22 is mounted upon the main frame 23 of the loom (not shown) with which the Jacquard machine co-operates.

The transmission assembly 20 flirter includes a stop 25 which is biased by springs 18 into abutment with the stop member 22 to define a lower shed position for the heralds 19.

The stop 25 is raised out of abutment with the stop member 22 when the output member 11 moves to its upper shed position US in order to move the heralds 19 to their upper shed position.

When the output member 11 is located at its lower shed position vibrations within the Jacquard mechanism can cause the output member 11 to vibrate or oscillate over a distance $V_0$. The transmission assembly 20 is constructed so as to define a vibration isolating connection between the stop 25 and member 11 so that vibrations or oscillations from the acquard are not transmitted to the harness 15 whilst the stop 25 is in abutment with stop member 22.

The vibration isolation connection is preferably defined by a lost-motion arrangement 30 whereby movements of the output member 11 within the range of movement $V_0$ are not transmitted to move the stop 25. In FIG. 1, the range of movement $V_0$ is shown as having an upper limit corresponding to the maximum distance and a lower limit corresponding to the minimum distance which the output member 11 is displaced relative to stop 25 by the vibration of the Jacquard. The lost motion accommodated by this arrangement 30 preferably has an upper limit LM spaced by a distance LE from the stop 25 and which slightly exceeds the upper limit of $V_0$ such that when the output member 11 is is raised by a distance slightly greater than distance LE the stop 25 is raised from stop member 22.

As shown in FIG. 1, the lost motion arrangement 30 may be in the form of a flexible inextensible member 32 which interconnects the output member 11 and the stop 25. The inextensible member 32 has a length which extends for distance LE so that when stop 25 is in abutment with stop member 22 the inextensible member 32 is in a collapsed state. Once member 11 is raised to distance LE, the inextensible member 32 is fully extended and thereafter raises the stop 25 as the member 11 continues to rise.

It is common in Jacquard mechanisms for the output member 11 to be biased downwardly onto a stop (not shown) to reside at its lower shed position. Accordingly, a resilient means 40 is preferably interconnected between the stop 25 and member 11 to provide a downwardly directed biasing force T for biasing the associated member 11 downwardly. The biasing force T is chosen to be sufficiently less than the biasing force $T_H$ in order to ensure that the stop 25 remains in abutment with stop member 22.

Figure 2:
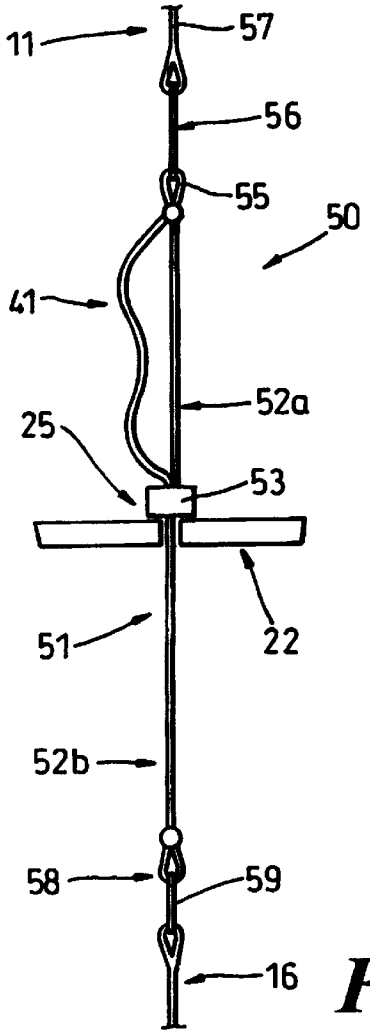
FIG. 2 is a schematic side view of a first embodiment according to the present invention.
Figure 3:
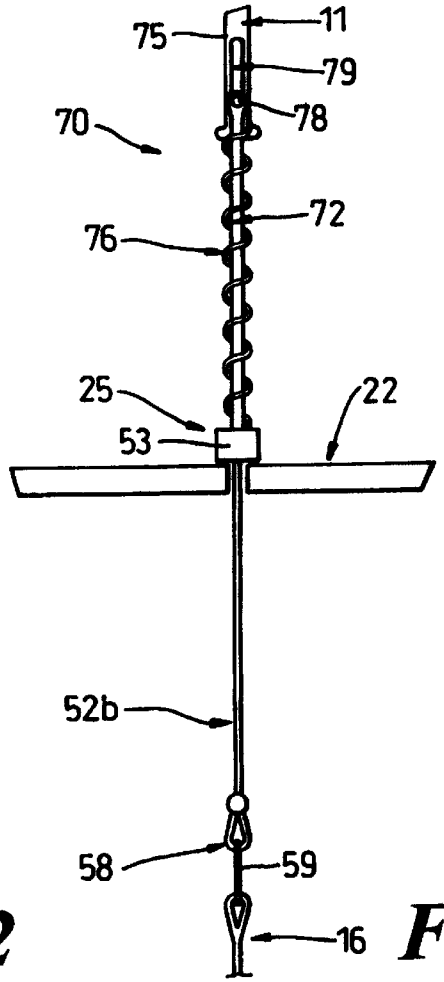
FIG. 3 is a schematic side view of a second embodiment according to the present invention.
Figure 4:
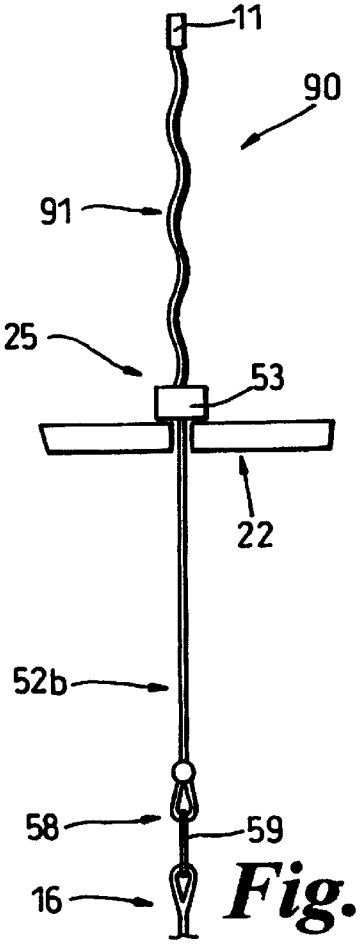
FIG. 4 is a schematic side view of a third embodiment according to the present invention.

Various embodiments are shown in FIGS. 2 to 4 wherein similar parts have been designated by the same reference numerals throughout.

In FIG. 2, a first embodiment 50 is illustrated including a transmission member 51 in the form of an inextensible flexible cord 52 having a stop block 53 attached thereto. The stop block 53 may be moulded from a suitable plastics material and may be moulded onto the cord 52. The stop block 53 defines stop 25. The cord 52 has an upper portion 52*a* which terminates in an upper eye formation 55 to provide an anchorage point for a connector 56 which in turn is connected to an output cord 57 from the Jacquard mechanism (not shown). The portion 52*a* of the cord 52 between stop block 53 and eye formation 55 is of length LE in order to provide the lost motion connection.

An elasticated strip 41 which defines the resilient means 40 is connected between the stop block 53 and eye formation 55. The elasticated strip 41 may for example be formed by one or multiple strands of elastomeric yarn such as LYCRA (RTM).

The cord 52 has a lower portion 52*b* which terminates in a lower eye formation 58 to provide an anchorage point for a connector 59 which in turn is connected to the harness cord(s) 16.

The length of lower portion 52*b* is sufficiently long to enable the harness 15 to be raised to its upper shed position without eye formation 59 abutting the underside of stop member 22.

The cord 52 may be of one continuous length or alternatively cord portions 52*a*, 52*b* may be separate and joined by or at the stop block 53.

In the second embodiment 70 illustrated in FIG. 3, the upper cord portion 52*a* is replaced by a rigid elongate member 72. In order to create lost motion the elongate member 72 is illustrated as being is connected to a rigid output connector 75 for the Jacquard mechanism by a pin 78 and slot 79 connection. The pin 78 and slot 79 are shown as being provided on the member 72 and connector 75 respectively but it will be appreciated that these may be reversed and be provided connector 75 and member 72 respectively if desired.

The length of slot 79 and its position relative to pin 78 is chosen to enable lost motion to occur over range $V_0$. The lower end of slot 79 is positioned to engage pin 78 when the output connector 75 has been raised by distance LE from the stop block 53. The resilient means 40 is in the form of a helical spring 76 which extends about and along the elongate member 72; the spring 76 being connected at its opposite ends to the connector 75 and stop block 53 respectively.

Conveniently the elongate member 72 may be formed from a suitable plastics material and may be integrally moulded with the stop block 53.

It is envisaged that the elongate member 72 may be pivotally connected to the output connector 75 and connected to the stop block 53 by a pin and slot connection similar to the pin and slot connection 78,79.

In the third embodiment 90 illustrated in FIG. 4, the upper portion 52*a* is replaced by a strip member 91 which is resiliently extendable lengthwise. The strip member 91 shown is formed from a resilient material so as to undulate along the length of the strip. The material is resilient enough to cause the strip member 91 to assume its undulated, retracted, form when relaxed but flexible enough to enable the strip member 91 to extend to a maximum extended length whereat the strip member 91 is substantially flat. When at its maximum extended length, the strip member 91 becomes inextensible and so enables the Jacquard to raise the stop block 53.

The strip member 91 may integrally include a stop face (not shown) at its lower end for abutment with stop member 22. Accordingly, with such an arrangement, stop block 53 may be dispensed with.

It is to be appreciated that the effective distance LE which the Jacquard output needs to travel before lifting of the stop 25 is a relative distance and that in practice it is envisaged that the stop member 22 will be adjustably mounted to enable its height to be adjusted relative to the jacquard output. In this way, the stop member 22 may be raised/lowered relative to the Jacquard output to ensure that the fully extended length of the upper portion of the transmission member has an effective length corresponding to distance LE.

In the above embodiments the stop 25 is in the form of a stop block 53 which is fixedly attached to cord 52 and which, on lowering of the cord 52, impacts against the stop member 22. Such impacts are transmitted along cord 52 and in some cases may be undesirable.

Figure 5:
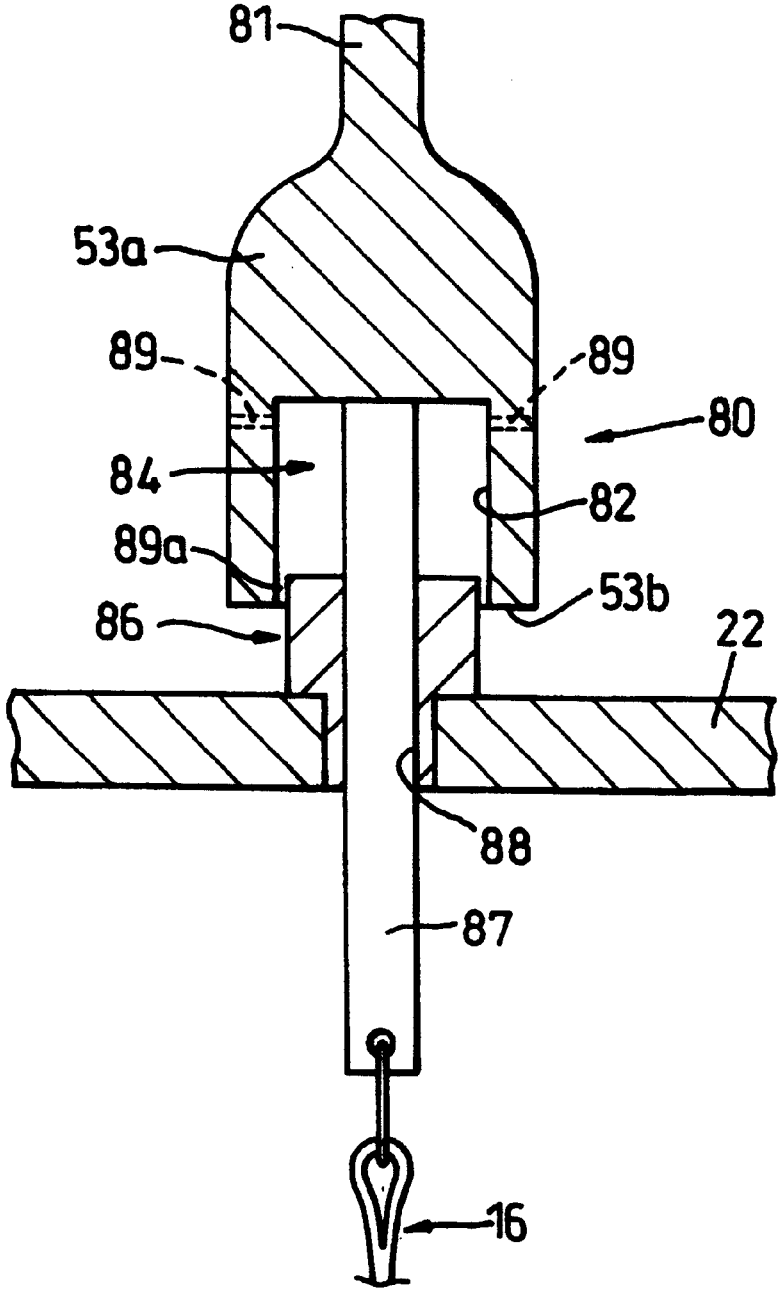
FIG. 5 is a schematic longitudinal section showing a modification to the drive transmission assembly according to the invention.

As exemplified in FIG. 5, it is therefore envisaged that dampening means 80 may be provided in order to dampen the impact of the stop block 53 onto the stop member 22.

In FIG. 5, the dampening means 80 includes a stop body 53*a* having an upper end 81 which may be connected to output member 11 by any of the lost motion arrangements 30 previously described.

The body 53*a* includes a piston cylinder 84 which is defined by an axially extending closed bore 82 which has a downwardly facing open end. A piston 86 is mounted on the stop 22. Preferably the piston 86 is slidably received within the cylinder 84 over at least the range of movement $V_0$.

The body 53*a* includes an axially extending guide rod 87 which projects beyond bottom stop face 53*b* of the body 53*a* and is slidably guided through a central bore 88 which extends axially through the piston 86. The length of guide rod 87 is such as to ensure that the guide rod 87 remains within the piston 86 throughout the range of reciprocal movement between the upper shed US and lower shed LS positions of the member 11.

Accordingly when the body 53*a* is lowered from the upper shed position toward the lower shed position, it is guided by the guide rod 87 such that the piston 86 enters into the piston cylinder 84. In so doing, air within the piston cylinder 84 is trapped and compressed and so acts as a cushion to dampen motion of the stop body 53*a*.

The degree of dampening required is determined by controlling the rate of escape of air from the piston cylinder 84. This may be achieved by providing one or more bleed vents 89 in body 53*a* and/or providing a desired gap 89*a* between opposed faces of the piston 86 and cylinder 84.

As the cylinder 84 vents, the body 53*a* is lowered in a dampened fashion until stop face 53*b* contacts stop member 22.

It is envisaged that the piston may be provided on the stop body 53 and the piston cylinder be mounted on stop member 22.

What is claimed is:

1. A drive transmission assembly for transmitting motive drive between a reciprocating drive member and a drive member in order to move the driven member in a path of reciprocal travel between first and second limits of reciprocal movement, the assembly including a drive transmission member connected to the drive member and the driven member in order to transmit said motive drive, a fixed stop member located within the path of reciprocal travel of said transmission member, the transmission member including a stop for abutment with said stop member in order to define said first or second limit of reciprocal movement for the driven member, said transmission member when connected to said drive and driven members defining a vibration isolating connection between said stop and said drive member whilst said stop is in abutment with said stop member.

2. An assembly according to claim 1 wherein dampening means are provided for dampening impact of the stop with said stop member.

3. An assembly according to claim 2 wherein the dampening means comprises a piston cylinder formed on the stop and a piston formed on the fixed stop member, the piston cylinder and piston co-operating to dampen motion of the stop towards the fixed stop.

4. An assembly according to claim 2 wherein the dampening means comprises a piston formed on the stop and a piston cylinder formed on the fixed stop member, the piston and piston cylinder co-operating to dampen motion of the stop towards the fixed stop.

5. An assembly according to claim 1 wherein the transmission member is in the form of an elongate flexible inextensible member connected at opposite ends to the drive member and stop respectively, the flexible inextensible member being longer than the distance between the drive member and the stop when the drive member is located at its limit position of reciprocal motion which is closest to the fixed stop member and the stop is in abutment with the fixed stop member.

6. An assembly according to claim 5 wherein biasing means are provided between the drive member and stop such that the drive member is biased toward the stop when the stop is in abutment with the fixed stop member and the drive member is located at its limit of reciprocal movement which is closest to the fixed stop member.

7. An assembly according to claim 1 wherein the transmission member is an elongate rigid member connected at opposite ends by first and second connection formations to the drive member and stop respectively, at least one of said connection formations permitting axial movement of the rigid member relative to the stop or drive member when the stop is in abutment with the fixed stop and the drive member is located at its limit position of reciprocal motion which is closest to the fixed stop member.

8. A jacquard machine including a plurality of output members interconnected to a plurality of heralds, each said output member being connected to one of said healds by a drive transmission assembly according to claim 1.

* * * * *